US008345916B2

(12) United States Patent
Schulze et al.

(10) Patent No.: US 8,345,916 B2
(45) Date of Patent: Jan. 1, 2013

(54) ELECTROACOUSTIC SOUND TRANSDUCER, RECEIVER AND MICROPHONE

(75) Inventors: Elmar Schulze, Lehrte (DE); Markus Kuhr, Singapore (SG)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 163 days.

(21) Appl. No.: 12/598,035

(22) PCT Filed: May 19, 2008

(86) PCT No.: PCT/EP2008/003988

§ 371 (c)(1),
(2), (4) Date: Mar. 15, 2010

(87) PCT Pub. No.: WO2008/141785

PCT Pub. Date: Nov. 27, 2008

(65) Prior Publication Data

US 2010/0215196 A1 Aug. 26, 2010

(30) Foreign Application Priority Data

May 18, 2007 (DE) ..... 10 2007 023 512

(51) Int. Cl.
*H04R 25/00* (2006.01)

(52) U.S. Cl. ..... 381/423; 381/398

(58) Field of Classification Search ..... 181/167, 181/169, 170, 171; 381/423, 426, 398; 442/320; 428/297.4, 297.7

See application file for complete search history.

(56) References Cited

U.S. PATENT DOCUMENTS

| | | | | | |
|---|---|---|---|---|---|
| 1,781,387 | A | * | 11/1930 | Harrison | 181/162 |
| 1,859,782 | A | * | 5/1932 | May | 181/162 |
| 2,439,665 | A | | 4/1948 | Marquis | |
| 2,624,417 | A | * | 1/1953 | Brennan | 181/169 |
| 4,375,182 | A | * | 3/1983 | Zavoda | 92/98 R |
| 2007/0047757 | A1 | | 3/2007 | Yang et al. | |

FOREIGN PATENT DOCUMENTS

| | | | |
|---|---|---|---|
| DE | 1910970 | | 9/1969 |
| DE | 4329637 | A1 | 3/1995 |
| DE | 10058274 | A1 | 5/2002 |
| EP | 1615466 | A2 | 1/2006 |
| GB | 19145038 | A | 0/1914 |
| JP | 56019298 | A | 2/1981 |
| JP | 60007299 | A | 1/1985 |
| WO | WO 2008/141875 | A4 | 11/2008 |

OTHER PUBLICATIONS

International Search report for PCT/EP2008/003988 mailed on Aug. 9, 2009; 3 pages.

Written opinion or PCT/EP2008/003988 mailed on Aug. 9, 2009; 5 pages.

* cited by examiner

*Primary Examiner* — Fan Tsang
*Assistant Examiner* — Phylesha Dabney
(74) *Attorney, Agent, or Firm* — Kilpatrick Townsend & Stockton LLP

(57) ABSTRACT

There is provided a dynamic sound transducer having a diaphragm with a ridge. First and second grooves (20, 30) are arranged on a first side of the ridge in such a way that the first and second grooves cross each other.

3 Claims, 3 Drawing Sheets

ELECTROACOUSTIC SOUND TRANSDUCER, RECEIVER AND MICROPHONE

CROSS-REFERENCE TO RELATED APPLICATIONS

Figure 1:
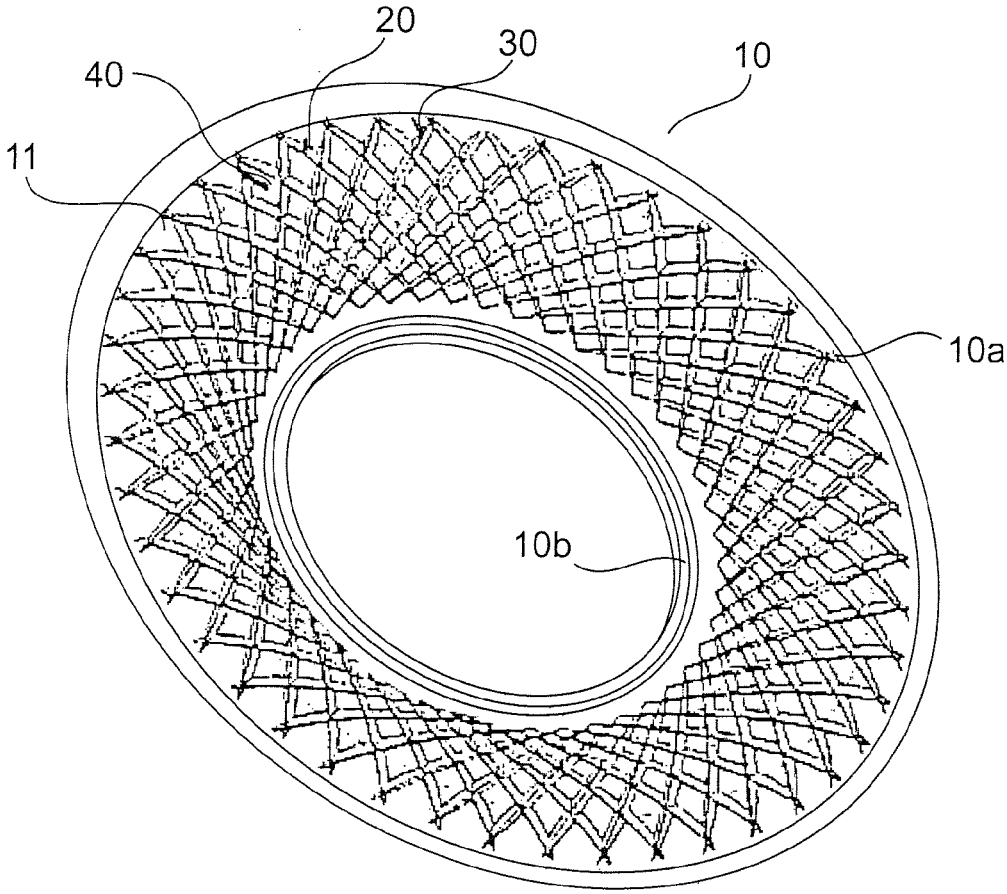

This application is a U.S. National Stage of PCT Application No. PCT/EP2008/003988 filed May 19, 2008, which claims the benefit of German Application No. 10 2007 023 512.9 filed May 18, 2007, the contents of both applications hereby incorporated by reference in their entirety.

The present invention concerns an electroacoustic sound transducer, a receiver or earphone and a microphone.

EP 1 615 466 discloses an electroacoustic sound transducer with a ridge which has a plurality of grooves extending radially.

U.S. Pat. No. 2,439,665 shows a loudspeaker diaphragm which in a region of the outer edge has impression portions extending concentrically relative to the center of the diaphragm. A plurality of radially arranged impression portions intersect the concentric impression portions.

DE 19 10 970 discloses an electroacoustic transducer comprising a diaphragm, the edge region of which has a plurality of folds forming a concertina-like series of inclined surfaces.

U.S. Pat. No. 1,859,782 discloses a diaphragm for a loudspeaker. The diaphragm has a plurality of mutually intersecting concentric circular impression portions.

The object of the present invention is to provide an electroacoustic sound transducer which has a lower resonance, frequency and permits an increase in the width of the transmission range.

That object is attained by an electroacoustic sound transducer according to claim 1.

That object is attained by a dynamic sound transducer having a diaphragm, wherein the diaphragm has a ridge. First and second grooves are arranged on a first side of the ridge in such a way that the first and second grooves cross each other.

In accordance with an aspect of the present invention rhomboidal raised portions or recesses are formed on the first side of the ridge by the crossing of the first and second grooves.

In accordance with a further aspect of the present invention the first and second grooves have different angles relative to a first end of the diaphragm.

In accordance with an aspect of the present invention the first and second grooves have different angles relative to an end of the diaphragm so that the first and second grooves cross each other asymmetrically.

According to a preferred embodiment of the invention the diaphragm is in the form of a film, the first and second grooves being impressed into the film.

The invention concerns the notion of providing an electroacoustic sound transducer system, wherein the system has a diaphragm having at least one bead or ridge. In that case the ridge has first and second groovings, with the first and second groovings crossing each other (on one side of the diaphragm). The intersection of the first and second groovings provides rhomboidal raised portions on a ridge surface. The rhomboids are preferably asymmetrical, which can be made possible by virtue of different angles of the first and second grooves. The rhomboidal structure of the ridge could be deformed by stretching or upsetting the grooves. The asymmetry of the groovings makes it possible to provide a preferred direction of the diaphragm or the ridge, whereby the deformation force required can be further reduced.

A diaphragm for such a transducer system permits an automated process and can be more easily removed from a mold.

In addition such a transducer has improved acoustic properties and a lower resonance frequency.

The above-described dynamic transducer can be used for example in a dynamic earphone or headphone or in a dynamic microphone.

Further configurations of the invention are subject-matter of the appendant claims.

Advantages and embodiments of the invention are described in greater detail hereinafter with reference to the drawing.

Figure 2:
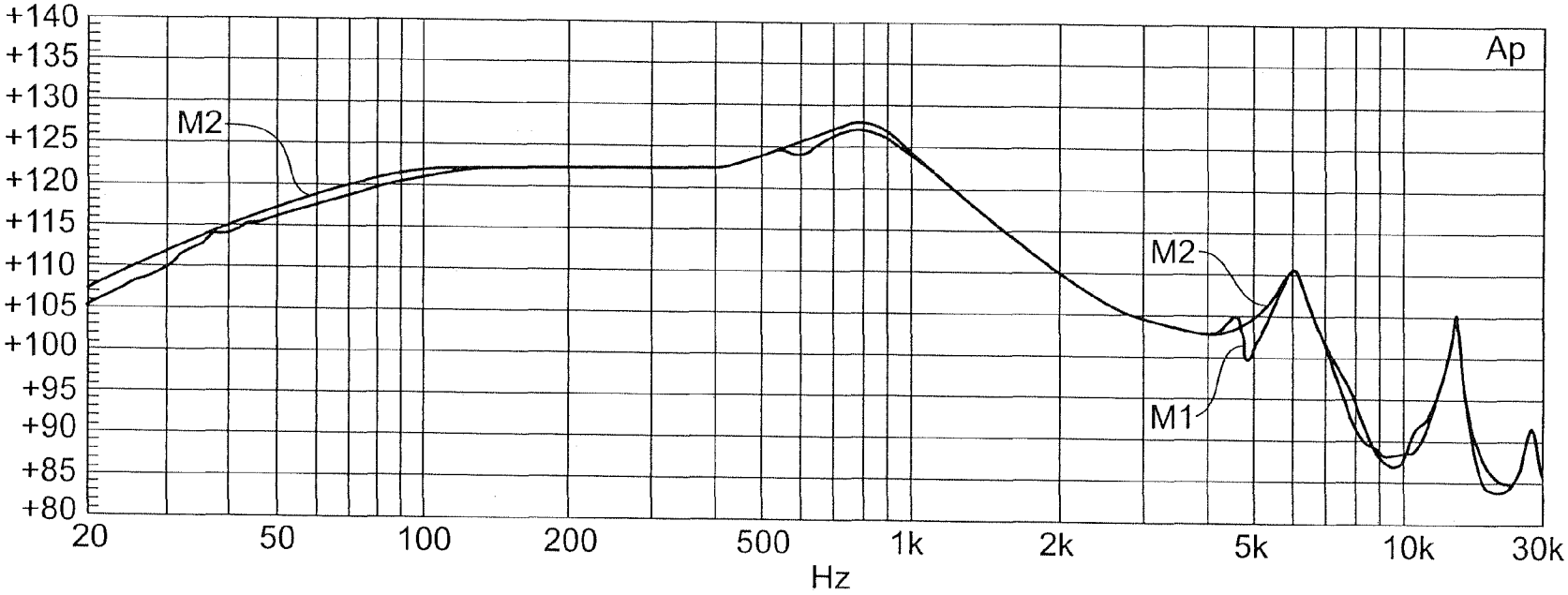
Figure 3:
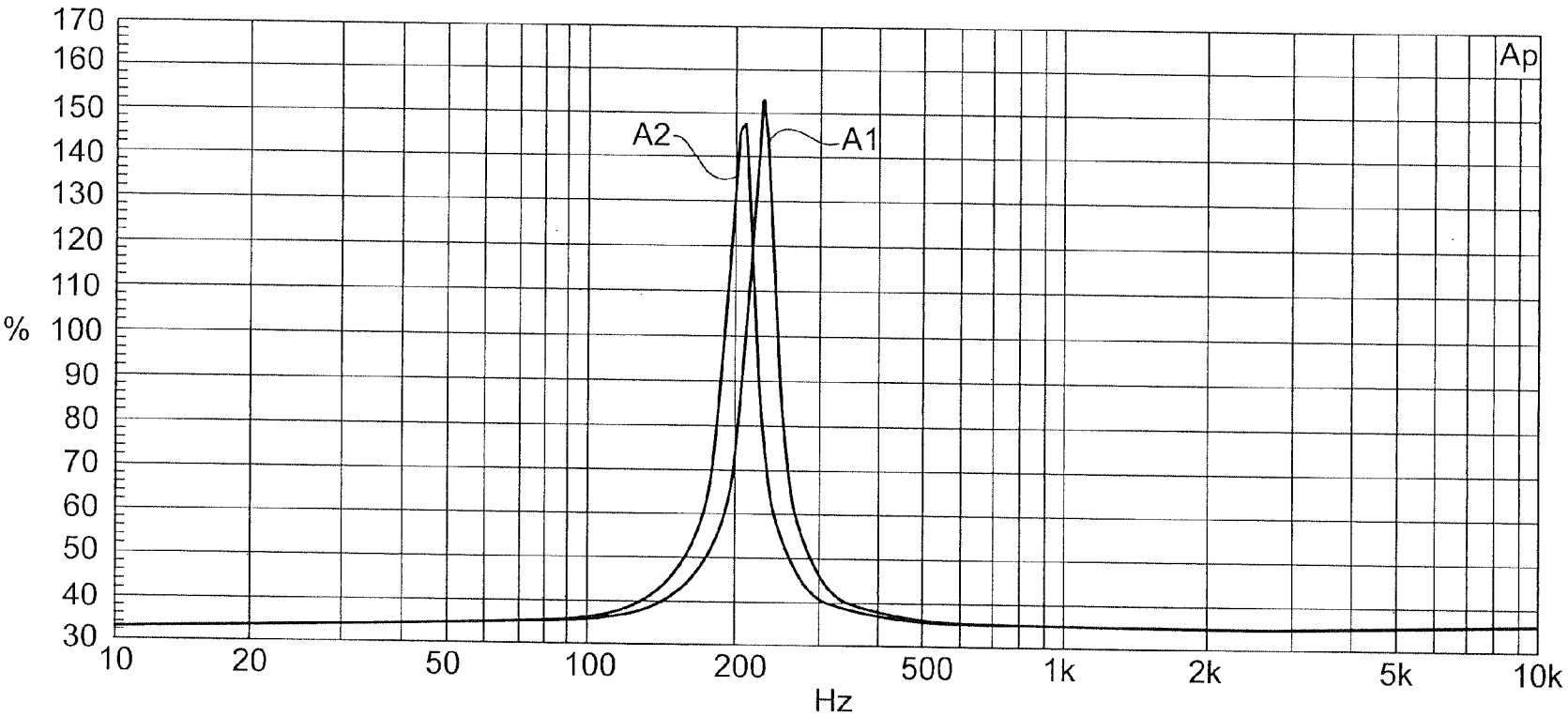

FIG. 1 shows a diagrammatic view of a diaphragm according to a first embodiment, FIG. 2 shows a frequency response characteristic of a diaphragm according to the state of the art and a diaphragm according to the first embodiment, and FIG. 3 shows a graph illustrating the impedance of a diaphragm according to the state of the art and a diaphragm according to the first embodiment.

FIG. 1 shows a diagrammatic view of a diaphragm according to a first embodiment. The diaphragm 10 has an outer end 10*a* and an inner end 10*b* as well as a bead or ridge 11 between the outer and inner ends 10*a*, 10*b*. First and second grooves 20, 30 are provided in the ridge 11 in such a way that the first and second grooves 20, 30 cross each other. Thus it is possible to obtain a diaphragm with asymmetric cross grooving on the ridge. The crossing relationship of the first and second grooves provides rhomboidal raised portions or recesses 40 (on one side of the ridge). Those rhombuses are of an asymmetrical configuration due to the different angles of the first and second groovings (with respect to an end 10*a*, 10*b* of the diaphragm). The rhomboidal structure of the ridge permits easier deformation when the ridge is stretched or upset.

FIG. 2 shows a view of the frequency response characteristic of a diaphragm according to the state of the art and the diaphragm according to the first embodiment. The diaphragm according to the state of the art has a single grooving while the diaphragm according to the first embodiment has a crossed grooving arrangement. The frequency response characteristic M1 of the diaphragm of the state of the art has modes at 5 kHz in the form of a dip. Such modes are not present with the frequency response characteristic M2 of the diaphragm according to the first embodiment. In addition the resonance frequency of the diaphragm according to the first embodiment is lower than the resonance frequency of the diaphragm of the state of the art and the frequency response characteristic M2 of the diaphragm according to the first embodiment shows a later drop to lower frequencies.

FIG. 3 shows an impedance characteristic of a diaphragm according to the state of the art and a diaphragm according to the first embodiment. The impedance characteristic A1 corresponds to the impedance characteristic of a diaphragm according to the state of the art and the impedance characteristic A2 corresponds to the impedance characteristic of a diaphragm according to the first embodiment. It will thus be clear that the resonance frequency of the diaphragm according to the first embodiment is less than the resonance frequency of the diaphragm according to the state of the art.

The diaphragm according to the first embodiment can be stamped for example from a (plastic) film. The plastic film can be for example about 6 μm in thickness.

The above-described dynamic acoustic transducer can be used for example in a dynamic headphone or in a dynamic microphone.

The invention claimed is:

1. A dynamic sound transducer comprising:

a diaphragm having a ridge, wherein first and second grooves are arranged on a first side of the ridge in such a way that the first and second grooves cross each other, wherein the first and second grooves cross each other in such a way that rhomboidal raised portions or rhomboidal recesses are provided on the first side of the ridge, wherein the first and second grooves have different angles relative to a first end of the diaphragm so that the rhomboidal portions have an asymmetrical shape, wherein the diaphragm represents a film and the first and second grooves are embossed into the film.

2. An earphone comprising a sound transducer as set forth in claim 1.

3. A microphone comprising a sound transducer as set forth in claim 1.

* * * * *

UNITED STATES PATENT AND TRADEMARK OFFICE

CERTIFICATE OF CORRECTION

PATENT NO. : 8,345,916 B2
APPLICATION NO. : 12/598035
DATED : January 1, 2013
INVENTOR(S) : Schulze et al.

It is certified that error appears in the above-identified patent and that said Letters Patent is hereby corrected as shown below:

In the Specification:

In column 1, lines 29-30, please delete "resonance, frequency" and insert --resonance frequency--.

Signed and Sealed this
Seventh Day of May, 2013

Teresa Stanek Rea
*Acting Director of the United States Patent and Trademark Office*